US006219890B1

(12) United States Patent
Souther

(10) Patent No.: US 6,219,890 B1
(45) Date of Patent: Apr. 24, 2001

(54) VEHICLE SAFETY ESCAPE APPARATUS

(75) Inventor: Douglas F. Souther, Phoenix, AZ (US)

(73) Assignee: Egression Technologies, L.L.C., Lebanon, PA (US)

( * ) Notice: Subject to any disclaimer, the term of this patent is extended or adjusted under 35 U.S.C. 154(b) by 0 days.

(21) Appl. No.: 09/268,117

(22) Filed: Mar. 15, 1999

(51) Int. Cl.[7] ..... A44B 11/25
(52) U.S. Cl. ..... 24/633; 24/631
(58) Field of Search ..... 24/633, 631, 602, 24/603, 163 K

(56) References Cited

U.S. PATENT DOCUMENTS

| | | | | |
|---|---|---|---|---|
| 3,751,785 | * | 8/1973 | Whitesell | 29/267 |
| 3,992,757 | * | 11/1976 | Danna | 24/633 |
| 4,194,764 | * | 3/1980 | Grimm | 24/603 |
| 4,313,230 | * | 2/1982 | Chovaniec | 24/163 K |
| 4,704,771 | * | 11/1987 | Orje | 24/633 |
| 4,987,662 | * | 1/1991 | Haffey et al. | 24/633 |
| 5,052,087 | * | 10/1991 | Portuese | 24/633 |
| 5,457,882 | * | 10/1995 | Clarke et al. | 29/885 |
| 5,496,131 | * | 3/1996 | Tiback | 299/40.1 |
| 5,987,716 | * | 11/1999 | Arai | 24/633 |

FOREIGN PATENT DOCUMENTS

| | | | | |
|---|---|---|---|---|
| 2509616 | * | 1/1983 | (FR) | 24/633 |

* cited by examiner

*Primary Examiner*—Victor N. Sakran
(74) *Attorney, Agent, or Firm*—Burns, Doane, Swecker & Mathis, L.L.P.

(57) ABSTRACT

Method and apparatus for escaping from a vehicle include providing safety escape apparatus including a safety belt having a buckle on a free portion of the belt, the buckle having an exposed edge, and the free portion being long enough to allow the exposed edge of the buckle to be placed in contact with a window of the vehicle. A tip harder than glass is affixed to the exposed edge of the buckle so as to extend outwardly therefrom. Escape is performed by disengaging the seat belt from a safety engaged position around an occupant, gripping the buckle with the tip extending outwardly, and forcibly driving the tip into an adjacent window to break the window and allow egress through the window.

16 Claims, 3 Drawing Sheets

VEHICLE SAFETY ESCAPE APPARATUS

FIELD OF THE INVENTION

This invention relates to safety apparatus and method of use.

More particularly, the present invention relates to safety apparatus for vehicles.

In a further and more specific aspect, the instant invention concerns apparatus and methods for escaping from vehicles.

BACKGROUND OF THE INVENTION

In many instances occupants of a vehicle, such as an automobile, a truck, etc., may be trapped inside the vehicle with the doors and windows inoperative. This is especially true in modern vehicles operated to a great extent electrically. For example, when an automobile is submerged in water for some reason, the electrical system is immediately inoperative and if the windows are electrical they cannot be opened. Even in many types of crashes, the doors and windows may be physically jammed so they cannot be opened by normal methods.

In such instances it is necessary to break a window so that egress or escape can be performed through the broken window. Windows in automobiles are constructed sufficiently thick and hard so that they cannot be inadvertently broken by slamming doors, minor bumps and crashes, etc. Thus, to break a window so that egress can be accomplished requires the use of some relatively heavy tool, such as a hammer, wrench, etc. The problem is that most people do not keep such equipment handy within their vehicles. While a tool specifically for this purpose could be stored in a convenient place within the vehicle, it could be difficult to acquire the tool under some circumstances. Also, at the specific times when such a tool is needed, because of the normal panic involved, it may be difficult to remember that the tool has been supplied or where it was stored.

It would be highly advantageous, therefore, to remedy the foregoing and other deficiencies inherent in the prior art.

Accordingly, it is an object of the present invention to provide new and improved vehicle safety escape apparatus and a method of use.

Another object of the invention is to provide new and improved vehicle safety escape apparatus and a method of use which is always handy and readily available.

And another object of the invention is to provide new and improved vehicle safety escape apparatus which is inexpensive.

Still another object of the present invention is to provide new and improved vehicle safety escape apparatus which is easily installed in new or already operating vehicles.

Yet another object of the invention is to provide new and improved vehicle safety escape apparatus and a method of use which is incorporated into a normal operating procedure.

SUMMARY OF THE INVENTION

Briefly, to achieve the desired objects of the instant invention in accordance with a preferred embodiment thereof, provided is a method and apparatus for escaping from a vehicle when windows and doors are difficult or impossible to open. Safety escape apparatus is provided which includes a safety belt having a buckle on a free portion of the belt long enough to allow an exposed edge of the buckle to be placed in contact with a window of the vehicle. The buckle has an exposed edge with a tip harder than glass affixed to the exposed edge so as to extend outwardly therefrom. Escape is performed by disengaging the seat belt from a safety engaged position around an occupant, gripping the buckle with the tip extending outwardly, and forcibly driving the tip into an adjacent window to break the window and allow egress through the window.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENT

Figure 1:
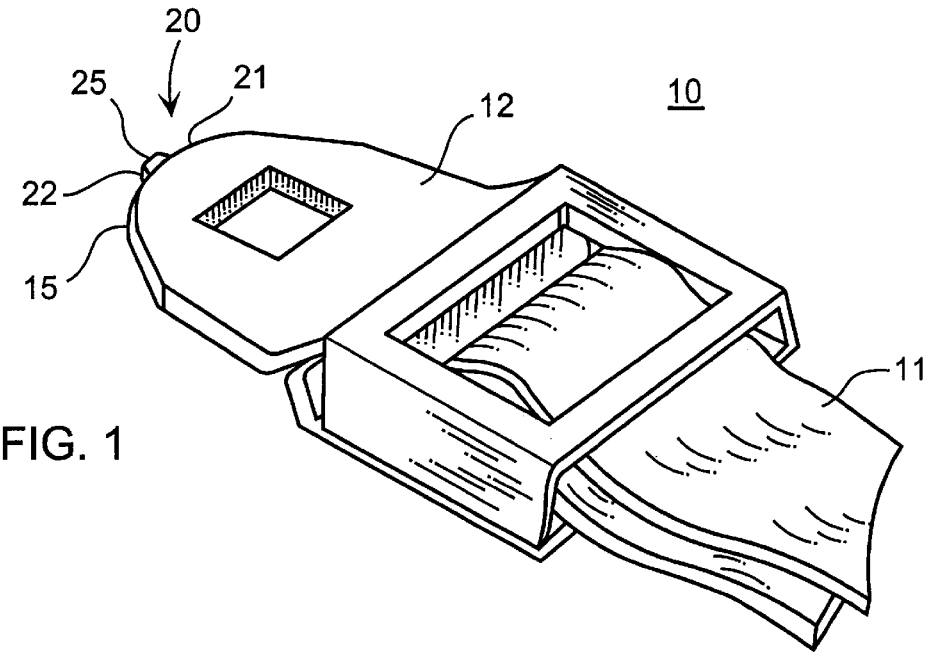
FIG. 1 is an isometric view of vehicle safety escape apparatus in accordance with the present invention.
Figure 2:
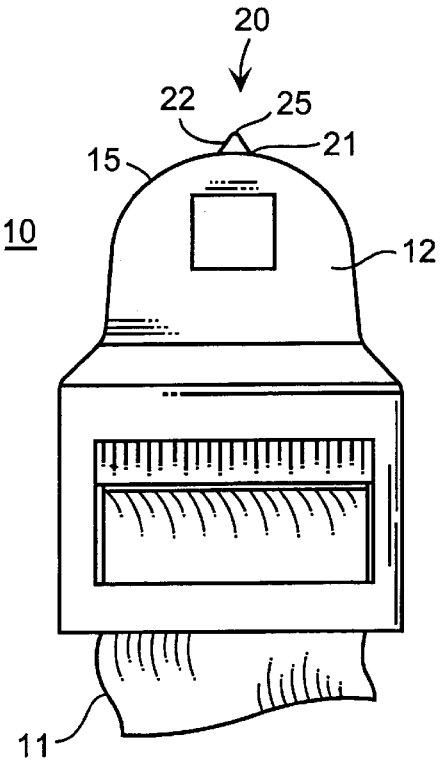
FIG. 2 is a view in top plan of the apparatus of FIG. 1.
Figure 3:
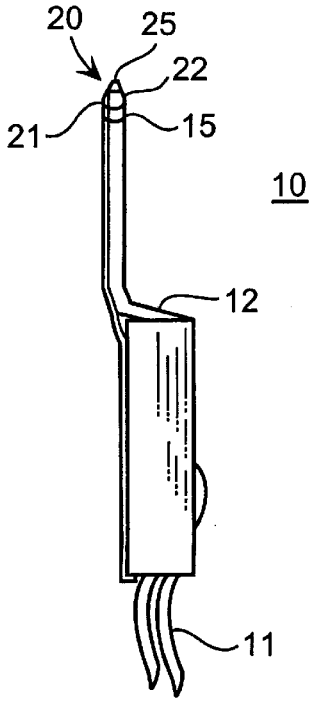
FIG. 3 is a view in side elevation of the apparatus of FIG. 1.

Turning now to the drawings in which like reference characters indicate corresponding elements throughout the several views, attention is first directed to FIG. 1 which illustrates vehicle safety escape apparatus 10 in accordance with the present invention. Apparatus 10 includes a safety belt 11 having a buckle 12 on a free portion of the belt. Buckle 12 has an exposed edge 15, which is designed to fit into a buckle receiver (not shown) with safety belt 11 extending around an occupant of the vehicle, in a normal and well known manner. The free portion of safety belt 11 is sufficiently long to allow exposed edge 15 of buckle 12 to be placed in contact with a window of the vehicle. Safety belt 11, whether a simple lap belt, a shoulder belt, or a combined lap and shoulder belt, generally has sufficient free movement (free portion) to allow the required window contact.

A tip 20 of material harder than glass is affixed to exposed edge 15 of buckle 12 so as to extend outwardly therefrom. Generally tip 20 is formed of some hard relatively unbreakable material such as a metal like steel, carbide, etc. In this preferred embodiment, tip 20 includes a base 21 affixed to exposed edge 15 of buckle 12 and sharply tapered sides 22 extending from base 21 outwardly to form an extended end 25. It is preferred that end 25 not be excessively sharp but rather culminate in a rounded surface so that force applied to buckle 12 will all be directed into the small area of end 25.

Figure 5:
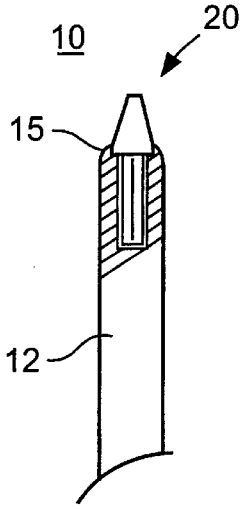
FIG. 5 is a cross-sectional view of the apparatus of FIG. 1, portions thereof broken away.
Figure 4:
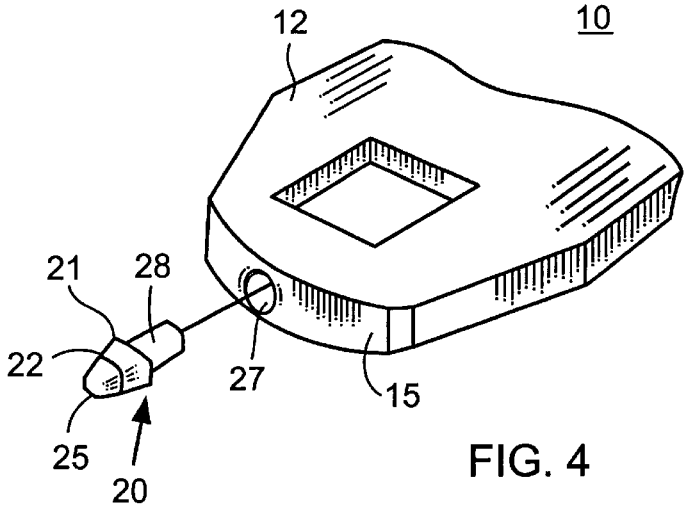
FIG. 4 is an isometric exploded view of the apparatus of FIG. 1, portions thereof broken away.

Turning now to FIGS. 4 and 5, it can be seen that an opening 27 is formed in exposed edge 15 of buckle 12. Tip 20 includes an elongated portion 28 that extends from base 21 in a direction opposite to end 25. Portion 28 is constructed to be frictionally engaged in opening 27. In the preferred embodiment, tip 20 is formed of carbide and is held in opening 27 by means of tungsten inert gas (TIG) welding. It will of course be understood that various adhesives or soldering may be utilized, if frictional engagement is not sufficient. Also, in original equipment, tip 20 could be formed integrally as an extension of buckle 12.

Figure 7:
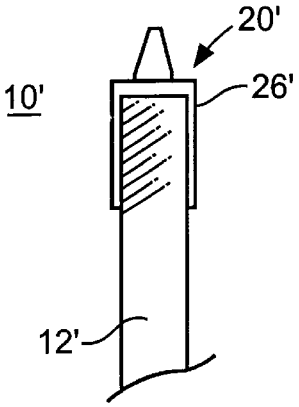
FIG. 7 is a cross-sectional view of the apparatus of FIG. 6, portions thereof broken away.
Figure 6:
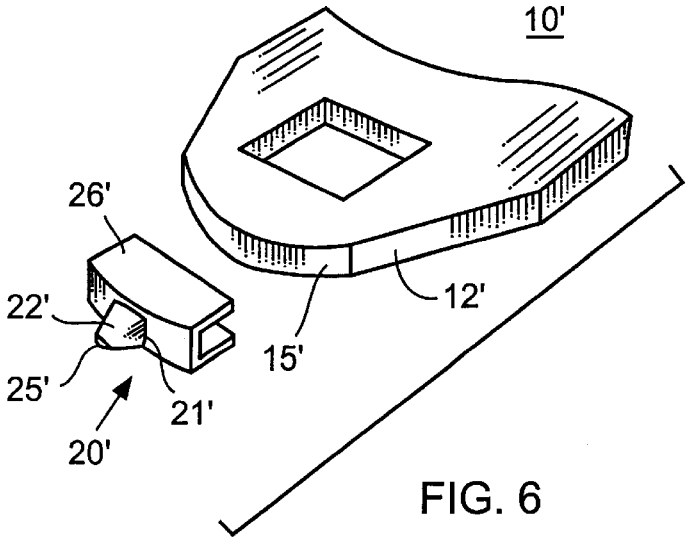
FIG. 6 is an isometric exploded view of another embodiment of vehicle safety escape apparatus in accordance with the present invention, portions thereof broken away.

Turning now to FIGS. 6 and 7, another embodiment is illustrated of vehicle safety escape apparatus 10' in which similar components are designated with similar numbers and a prime is added to indicate the different embodiment. Apparatus 10' includes a safety belt (not shown) having a buckle 12' on a free portion of the belt. Buckle 12' has an exposed edge 15', which is designed to fit into a buckle receiver (not shown) with the safety belt extending around an occupant of the vehicle, in a normal and well known manner. The free portion of the safety belt is sufficiently long to allow exposed edge 15' of buckle 12' to be placed in contact with a window of the vehicle.

A tip 20' of material harder than glass is affixed to exposed edge 15' of buckle 1' so as to extend outwardly therefrom. Generally, as explained above, tip 20' is formed of some hard relatively unbreakable material such as a metal like steel, carbide, etc. In this preferred embodiment, tip 20' includes a base 21' and sharply tapered sides 22' extending from base 21' outwardly to form an extended end 25'. Tip 20' includes a clamp 26' with a generally U-shaped cross-section and base 21' is affixed to clamp 26' with end 25' extending outwardly. Clamp 26' is constructed to be frictionally engaged over edge 15' of buckle 12' with end 25' extending outwardly therefrom away from edge 15' of buckle 12'. Additional holding means, such as adhesive (e.g. epoxy), soldering welding, etc. may be used if required.

In a preferred method of escaping from a vehicle in which the occupant is trapped and cannot open the doors or windows normally the following steps are used. First, the vehicle must be one in which the above described safety apparatus is provided. In the preferred embodiment, the safety belt around the occupant includes a buckle with an exposed edge which is designed to fit into a buckle receiver with the safety belt extending around the occupant of the vehicle, in a normal and well known manner. Here it should be noted that in the preferred embodiment the tip is attached to the exposed edge so that it is completely covered by the buckle receiver and cannot cause damage during periods of nonuse. It should be understood however that the tip can be attached to other convenient edges of a safety belt buckle and the present embodiment is preferred because of its convenience.

Figure 8:
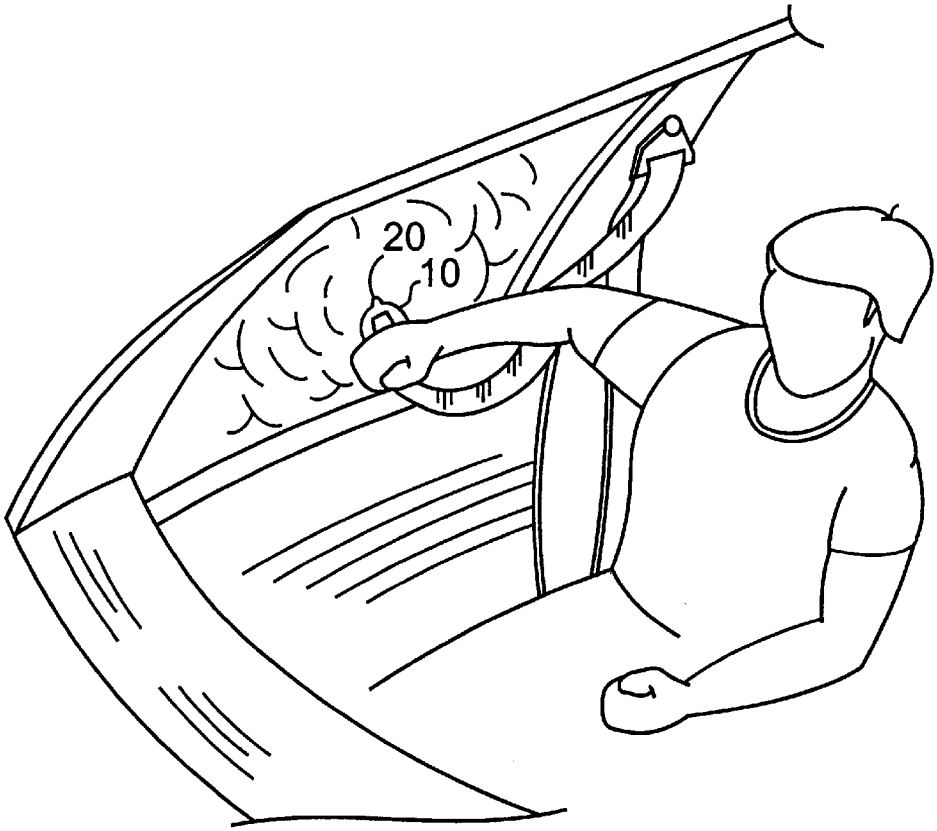
FIG. 8 is an isometric view illustrating a method of use of the vehicle safety escape apparatus in accordance with the present invention.

Next, the occupant disengages the seat belt from the safety engaged position around himself, which generally entails gripping the buckle and engaging a release device (e.g. pushing a button) in the buckle receiver. In most instances, the buckle is automatically gripped with the tip extending outwardly, generally as illustrated in FIG. 8. The occupant is then automatically in a position to forcibly drive the tip affixed to the edge of the buckle into an adjacent window to break the window and allow egress through the window. Because of the hardness of the tip and because the tip is constructed with a relatively small surface area, the force applied to the window at the tip is very large and the window easily and immediately breaks. Also, because the tip is a part of the safety belt which must be removed before the occupant can exit the vehicle, there is no need for the occupant to search for an instrument with which to break the window. Thus, time and possible confusion or panic are saved and the occupant can egress the vehicle quickly and safely.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. Vehicle safety escape apparatus comprising:

a safety belt having a buckle on a free portion of the belt, the buckle having an exposed edge, and the free portion being long enough to allow the exposed edge of the buckle to be placed in contact with a window of the vehicle; and a tip of material harder than glass affixed to the exposed edge of the buckle so as to extend outwardly therefrom to break the window and allow egress therefrom.

2. Vehicle safety escape apparatus as claimed in claim 1 wherein the tip includes metal.

3. Vehicle safety escape apparatus as claimed in claim 2 wherein the metal includes carbide.

4. Vehicle safety escape apparatus as claimed in claim 3 wherein the metal tip including carbide is attached to the edge of the buckle by a tungsten inert gas weld.

5. Vehicle safety escape apparatus as claimed in claim 2 wherein the edge of the buckle has an opening formed therein and the metal tip has an elongated portion that is inserted into the opening.

6. Vehicle safety escape apparatus as claimed in claim 1 wherein the tip includes a base affixed to the edge of the buckle and a sharply tapered portion extending from the base outwardly to form an extended end.

7. Vehicle safety escape apparatus as claimed in claim 1 wherein the tip includes a clamp with a generally U-shaped cross-section and a base affixed to the clamp with a sharply tapered portion extending from the base outwardly to form an extended end, and the clamp is engaged over the edge of the buckle with the end extending outwardly therefrom away from the edge of the buckle.

8. Vehicle safety escape apparatus as claimed in claim 1 wherein the buckle is designed to be engaged in a buckle receiver and the edge of the buckle and the tip are covered by the buckle receiver when the safety belt is engaged about an occupant of the vehicle in the buckle receiver.

9. Vehicle safety escape apparatus comprising:

a safety belt having a buckle on a free portion of the belt, the buckle having an exposed edge, and the free portion being long enough to allow the exposed edge of the buckle to be placed in contact with a window of the vehicle;

a tip including a base affixed to the edge of the buckle and a sharply tapered portion extending from the base outwardly to form an extended end, the tip including carbide; and the buckle being designed to be engaged in a buckle receiver with the edge of the buckle and the tip being covered by the buckle receiver when the safety belt is engaged about an occupant of the vehicle and in the buckle receiver to break the window and allow egress therefrom.

10. Vehicle safety escape apparatus as claimed in claim 9 wherein the tip including carbide is attached to the edge of the buckle by a tungsten inert gas weld.

11. Vehicle safety escape apparatus as claimed in claim 9 wherein the edge of the buckle has an opening formed therein and the tip has an elongated portion that is inserted into the opening.

12. Vehicle safety escape apparatus as claimed in claim 9 wherein the tip includes a clamp with a generally U-shaped cross-section and a base affixed to the clamp with a sharply tapered portion extending from the base outwardly to form an extended end, and the clamp is engaged over the edge of the buckle with the end extending outwardly therefrom away from the edge of the buckle.

13. A method of escaping from a vehicle comprising the steps of:

providing safety escape apparatus including a safety belt having a buckle on a free portion of the belt, the buckle having an exposed edge, and the free portion being long enough to allow the exposed edge of the buckle to be placed in contact with a window of the vehicle, and a tip harder than glass affixed to the exposed edge of the buckle so as to extend outwardly therefrom;

disengaging the seat belt from a safety engaged position around an occupant;

gripping the buckle with the tip extending outwardly; and forcibly driving the tip into an adjacent window to break the window and allow egress through the window.

14. A method of escaping from a vehicle as claimed in claim 13 wherein the step of providing safety escape apparatus includes providing a metal tip.

15. A method of escaping from a vehicle as claimed in claim 13 wherein the step of providing the metal tip includes providing a carbide tip.

16. A method of escaping from a vehicle as claimed in claim 13 wherein the step of providing the safety escape apparatus includes the buckle being designed to be engaged in a buckle receiver with the edge of the buckle and the tip being covered by the buckle receiver when the safety belt is engaged about an occupant of the vehicle and in the buckle receiver.

* * * * *